US007861773B2

(12) United States Patent
Xu

(10) Patent No.: US 7,861,773 B2
(45) Date of Patent: Jan. 4, 2011

(54) RETRIEVABLE BRIDGE PLUG

(76) Inventor: Jian Xu, Downhole Production Jiangsu Oilfield, Jiangsu Province, Sinopec Jiangdu, 225265 (CN)

( * ) Notice: Subject to any disclaimer, the term of this patent is extended or adjusted under 35 U.S.C. 154(b) by 89 days.

(21) Appl. No.: 11/994,814

(22) PCT Filed: Jul. 4, 2006

(86) PCT No.: PCT/CN2006/001559

§ 371 (c)(1),
(2), (4) Date: May 30, 2008

(87) PCT Pub. No.: WO2007/003138

PCT Pub. Date: Jan. 11, 2007

(65) Prior Publication Data

US 2008/0314583 A1 Dec. 25, 2008

(30) Foreign Application Priority Data

Jul. 4, 2005 (CN) ..... 2005 2 0073237 U

(51) Int. Cl.
*E21B 23/00* (2006.01)
*E21B 23/01* (2006.01)

(52) U.S. Cl. ..... 166/123; 166/135; 166/119; 166/118; 175/423

(58) Field of Classification Search ..... 166/118, 166/119, 123, 135; 175/423
See application file for complete search history.

(56) References Cited

U.S. PATENT DOCUMENTS

| | | | | |
|---|---|---|---|---|
| 5,085,273 | A * | 2/1992 | Coone | 166/242.1 |
| 5,368,335 | A | 11/1994 | Dinnes | |
| 6,220,348 | B1 * | 4/2001 | Serafin et al. | 166/133 |
| 6,315,041 | B1 * | 11/2001 | Carlisle et al. | 166/250.17 |

FOREIGN PATENT DOCUMENTS

| | | | |
|---|---|---|---|
| CN | 2276554 | Y | 3/1998 |
| CN | 2305482 | Y | 1/1999 |
| CN | 2425196 | Y | 3/2001 |
| CN | 2707952 | Y | 7/2005 |

* cited by examiner

*Primary Examiner*—Kenneth Thompson
*Assistant Examiner*—Michael Wills, III
(74) *Attorney, Agent, or Firm*—Workman Nydegger

(57) ABSTRACT

Retrievable bridge plug used in oil and gas wells comprises a setting and anchoring mechanism, a locking and releasing mechanism and a sealing and anti-adhering mechanism. The bridge plug in which a self-lock mechanism is placed can be lowered through an coiled tubing or wireline, and provide reliable bi-directional sealing, and can be taken out by a specific tool after setting, in order to be used repeatedly after simple maintenance. By replacing its mandrel, the bridge plug can be refitted into a squeezing bridge plug, a conventional one and a hook-wall bridge plug to be used in a temporary/permanent and selective blocking operation. Also, the bridge plug can be associated with other downhole tools to perform well test, layer protection and snubbing.

3 Claims, 6 Drawing Sheets

RETRIEVABLE BRIDGE PLUG

CROSS REFERENCE TO RELATED APPLICATIONS

This application is a National Stage application which claims the benefit of International Application No. PCT/CN2006/001559 filed Jul. 4, 2006, which claims priority based on CN 200520073237.9 filed Jul. 4, 2005, each of which is hereby incorporated by reference their entirety.

TECHNICAL FIELD

This disclosure relates to oil & gas downhole setting tools, especially to a retrievable blocking tool.

BACKGROUND

During oil & gas exploration and production, especially for oil testing, downhole operation, oil & gas layer reconstruction, stratum testing, injection and production adjustment; temporary or permanent blocking to an oil/gas/water layer; using blocking tools is needed. In some cases, squeezing cement to block a perforated interval or channeling outside casing is also required for secondary cementing. A retrievable bridge plug is one retrievable blocking tool. When blocking is needed, the bridge plug is placed down to predetermined position, calibrating the depth, a setting controlled from ground, and temporary, permanent or selective blocking may be performed to the destination layer. Depending on the construction requirement, the retrievable bridge plug may be also used for a squeezing operation. Additionally, the retrievable bridge plug may be associated with other downhole tools to perform production well testing, oil/gas layer protection and snubbing, etc. A special releasing tool applies for retrieval of the bridge plug. Repeatable use of the bridge plug is possible after simple maintenance.

Chinese patent Patent Number 00 2 20245.x discloses a retrievable bridge plug which is sent in for setting by coiled tubing or a wire line. This bridge plug has full function and stable performance and may be associated with other downhole tools such as inserting slide bushing switch, but it can not be used for the squeezing operation, because the bridge plug can not be taken out after the cement hardens into concrete. A sleeving valve cement retainer referred to as "WSRA" manufactured by SIJISERVA (Hubei, Jingzhou) with a simple structure is low in cost and can be used for a secondary cement squeezing operation. However, there are disadvantages associated with the tool. First, this tool employs integral cast steel structure, which sometimes results in accidental jamming for the horizontal wells and high angle wells. Second, it sticks to the cement and results in unsuccessful release of the plug for squeezing cementing operation.

SUMMARY

The purpose of this disclosure is to overcome the disadvantages of the existing technology and provide a retrievable bridge plug with high reliability, wide application and simple structure.

The above purpose is realized through the followed exemplary technical scheme. With reference to FIG. 1, the retrievable bridge plug comprises, a setting and anchoring mechanism, a locking and releasing mechanism, and a sealing and anti-adhering mechanism.

(1) The setting and anchor mechanism comprises an upper connector [1], a connector [5], a mandrel [8], an anchor cone [9], an anchor [10]and an anchor sleeve [11]. The upper connector [1] connects to the connector [5] through a pin [18], which avoids blocking when the bridge plug is lifted out of the wellbore. The connector [5] connects with the mandrel [8] through thread. A "weak point" of an annular recess is set at the upper portion of the mandrel [8], which controls the setting force of the bridge plug. On the outside surface of the anchor [10], there is a set of teeth [19] which are reverse in direction. The tooth-tip angle a ranges from 85-100°. There is a dovetail slot [21] for a sliding connection between the anchor cone [9] and an anchor [10]. The anchor [10] is embedded into the open window of the anchor sleeve [11]. The cone angle β of the anchor cone [9] is 8-10°. The angle γ between the two profile surfaces and outside surface of the anchor is 28-350°. When setting, the anchor cone [9] pushes the anchor [10] to bite into the inner wall of the casing. Due to the smart combination of the anchor cone [9], anchor [10] and anchor sleeve [11], during operation, the higher differential pressure, the tighter anchoring between the bridge plug and casing. Therefore, the anchoring mechanism of the bridge plug has good bi-directional locking performance and can endure higher differential pressure. (2) The locking and releasing mechanism comprises: a releasing sleeve [2], a locking piece [3], a lock sleeve [4], an open lock ring [6], a mandrel [8] and an anchor cone [9]. A lock sleeve [4] is embedded into the anchor cone [9], both of which are connected with the locking piece [3] in the shape of arc. The cross section of the locking piece [3] is a combination of a rectangle and a trapezoid, wherein the rectangle part is assembled into a rectangle window of the anchor cone [9] and the trapezoid part is assembled into a trapezoid groove of the lock sleeve [4]. The inner diameter of releasing sleeve [2] is equal to the outer diameter of the locking piece [3]. Unidirectional thick sawtooth threads with same pitch are set on the outside surface of the open lock ring [6] and inside the lock sleeve [4]. Unidirectional thin sawtooth threads with same pitch are set inside the open lock ring [6] and outside the mandrel [8]. Left-hand threads for releasing are set at the upper portion of releasing sleeve [2].

(3) The sealing and anti-adhering mechanism comprises a rubber Cylinder [12], a slide bushing [13], a sealed mandrel [15]and an anti-adhering layer [16]. The rubber cylinder [12] is installed on the sealed mandrel [15] and the slide bushing [13] is installed within the sealed mandrel [15] and keeps sealed with it via an O-ring [14]. One end of the slide bushing [13] is equipped with a circlip structure and a liquid discharge hole. The inside of the slide bushing [13] is equipped with an annular recess. The lower portion of the sealed mandrel [15] is conical, which has an anti-adhering layer [16] set on its surface. The anti-adhering layer is made of perduren or other organic material.

The above sealed mandrel [15] can be refitted into sealed mandrel [15'] and sealed mandrel [15"]. And the bridge plug can be refitted into a conventional bridge plug (mandrel sealing) and hook-wall bridge plug (mandrel through).

The sealed mandrel [15] and rubber sleeve [12] of above mentioned bridge plug can also be set at an upper portion of anchor [10] to refit the bridge plug into a conventional one.

The downhole operation is as follows:

Setting: The plug and setting tool are connected and placed down to a predetermined position, and then the depth is calibrated to force the setting tool to push the upper connector [1] to move downward to cut off the pin. Anchor cone [9] pushes the anchor [10] to bite into the inner wall of the casing to compress the rubber sleeve [12] of the bridge plug for sealing the annular space of the casing. At the same time, the unidirectional thin sawtooth threads on the open lock ring [6] and outside the mandrel [8] engage with each other. The internal structure of the bridge plug realizes self-lock. When the pulling force of the setting tool exceeds the limit of the breaking strength of the "weak point" on the mandrel, the "weak point" is broken up. The connector [5] is taken out of the ground following the setting tool. The retrievable bridge plug is set at the predetermined position.

When the squeezing operation is needed, an inserting tube is placed down and inserted into the retrievable bridge plug, which opens the slide bushing [13] to perform the squeezing operation. After the squeezing operation is done, the tubing is pulled up to take out the inserting tube and the slurry is concreted.

Releasing: A special releasing tool is placed down to grasp the releasing sleeve [2] and pulls it up slowly, cut off the pin. Locking piece [3] slides out of the trapezoid groove of the lock sleeve [4] to release the self-lock of the bridge plug. The rubber sleeve [12] begins to shrink. The anchor cone [9] moves upwards and brings the anchor [10] back to the anchor sleeve [11], and the bridge plug is released. The assembly is then taken out of the ground together with the releasing tool. The bridge plug can be used repeatedly after simple maintenance.

Compared with existing technology, the advantages of this invention are as follows:

1. Flexible setting: The bridge plug is sent in and set by a wireline setting tool or hydraulic setting tool which is selected according to the specific condition.

2. Accurate setting control: The setting force of the bridge plug is controlled by the "weak point" on the mandrel to assure the reliable setting of the bridge plug. In the meantime, the setting tool can be lifted out of the wellbore in any complex environment.

3. Stable anti-locking design: the anchor part employs a built-in structure, which avoids blocking when the bridge plug is lifted out of the wellbore. Therefore the bridge plug can be used safely in the well with any inclination; and an anti-adhering structure is set at the lower portion of the bridge plug, so it can be taken out safely after concreting of the slurry.

4. Unique anchoring mechanism: The smart combination of anchor, anchor cone and outer casing of the anchor makes the single set anchor have bi-directional pressure endurance which is suitable for the casings of various grades.

5. Reliable releasing mechanism: The release of the bridge plug is performed by a special releasing tool and executed in the sequence of the locking mechanism, sealing mechanism and anchoring mechanism. Whether or not the up and down pressure is balanced, only a small pulling force is needed for releasing.

6. Wide application: The bridge plug is equipped with a multi-function squeezing inserting tube for the squeezing operation. When the slurry concretes, the bridge plug can be taken out directly by the inserting tube and can be used repeatedly after simple maintenance. By replacing its mandrel, the bridge plug can be refitted into a conventional bridge plug (mandrel sealing) and a hook-wall bridge plug (mandrel through) to be used in temporary/permanent and selective blocking operations, production well testing, oil/gas layer protection and snubbing, etc.

BRIEF DESCRIPTION OF THE DRAWINGS

Attached drawing illustrates.

DETAILED DESCRIPTION

Figure 1:
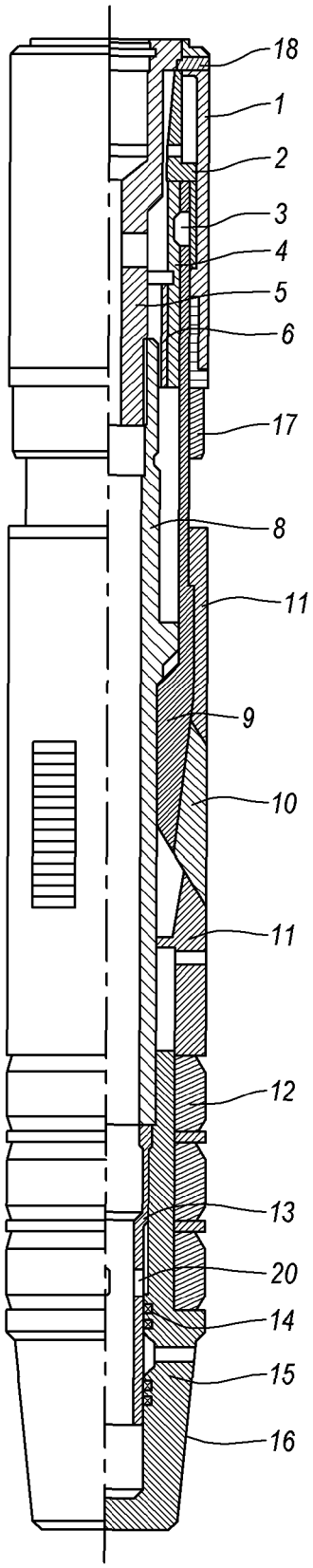
FIG. 1 illustrates the structure diagram of an embodiment of the present retrievable bridge plug.
Figure 2:
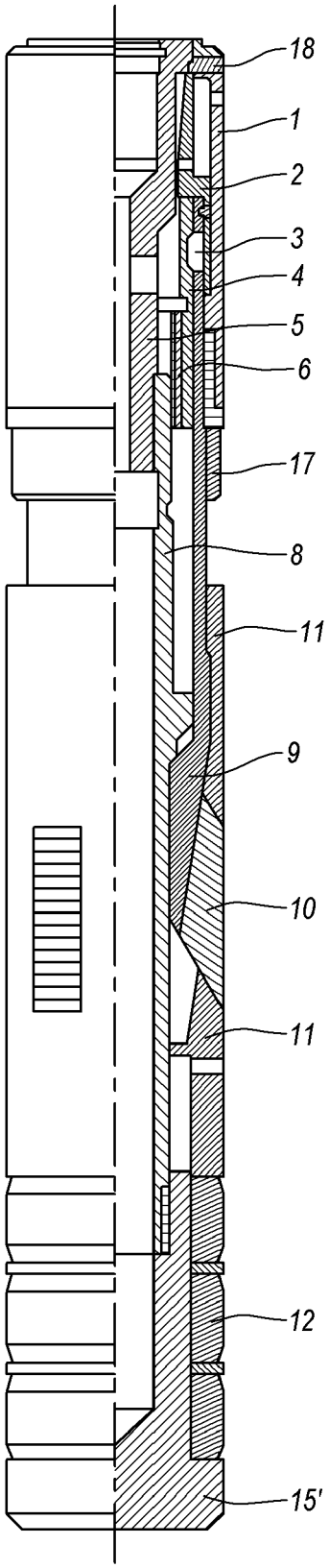
FIG. 2 illustrates the structure diagram of another embodiment of the present retrievable bridge plug.
Figure 3:
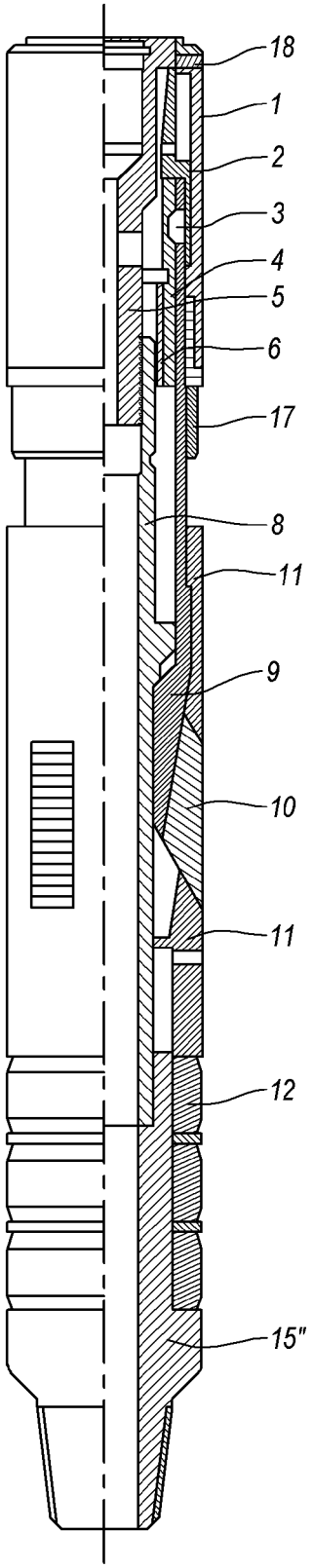
FIG. 3 illustrates the structure diagram of another embodiment of the present retrievable bridge plug.
Figure 4:
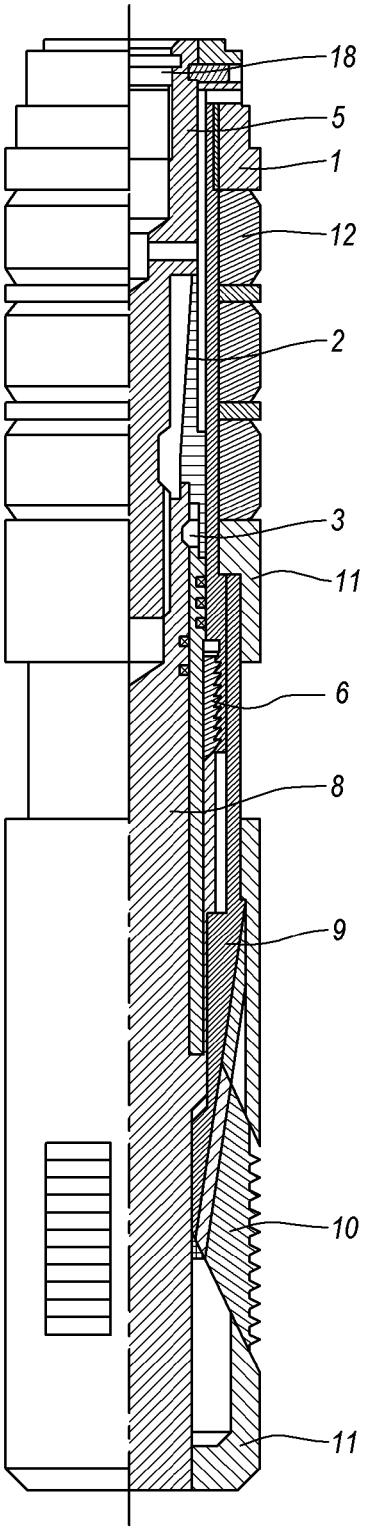
FIG. 4 is a partial enlarged view of a plug locking mechanism.
Figure 5:
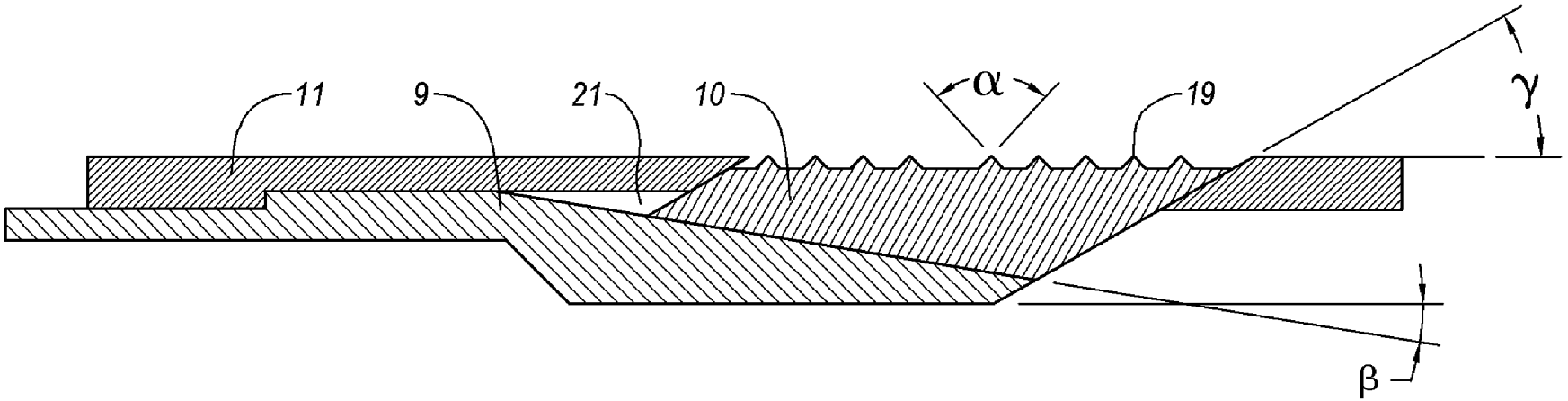
FIG. 5 is a partial enlarged view of a plug releasing mechanism.

Referring to FIGS. 1, 4 and 5, a detailed description will be made incorporating the accompany drawings (Example 1). The retrievable bridge plug comprises a setting and anchoring mechanism, a locking and releasing mechanism and a sealing and anti-adhering mechanism.

The setting and anchor mechanism comprises an upper connector [1], a connector [5], a mandrel [8], an anchor cone [9], an anchor [10] and an anchor sleeve [11]. The upper connector [1] connects to the connector [5]through a pin [18], which avoids blocking when the bridge plug is lifted out of the wellbore. The connector [5] connects with the mandrel [8] through thread. A "weak point" of an annular recess is set at an upper portion of the mandrel [8], which controls the setting force of the bridge plug. On the outside surface of the anchor [10], there is a set of teeth [19] which are reverse in the direction. The tooth-tip angle $\alpha$ranges from 85-100°. There is a dovetail slot [21] for the sliding connection between the anchor cone [9] and anchor [10]. The anchor [10] is embedded into the open window of the anchor sleeve [11]. The cone angle $\beta$ of the anchor cone [9] is 8-10°. The angle $\gamma$ between the two profile surfaces and the outside surface of the anchor is 28-350. When setting, the anchor cone [9]pushes the anchor [10] to bite into the inner wall of the casing. Due to the smart combination of the anchor cone [9], anchor [10] and anchor sleeve [11], during operation, the higher differential pressure, the tighter anchoring between the bridge plug and casing. Therefore, the anchoring mechanism of the bridge plug has good bi-directional locking performance and can endure higher differential pressure.

Figure 6:
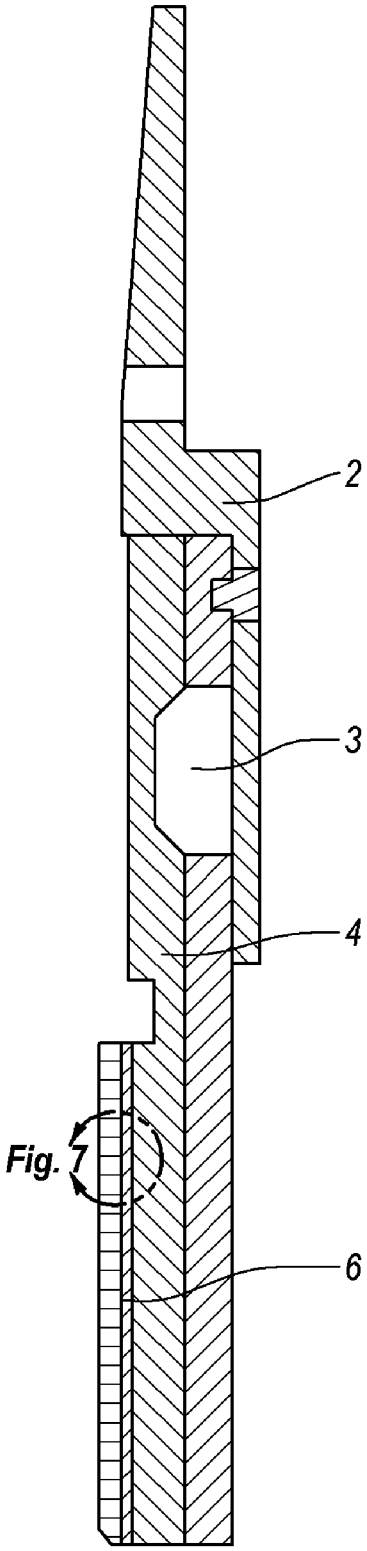
FIG. 6 illustrates a structure diagram of an embodiment of a locking mechanism.
Figure 7:
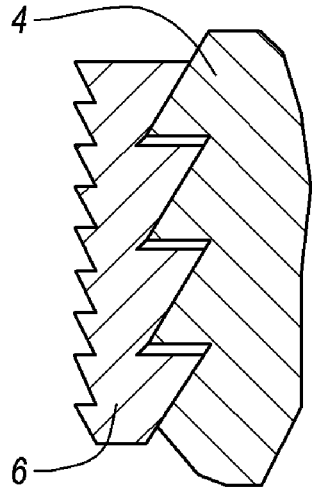
FIG. 7 illustrates an expanded view of a portion of the locking mechanism illustrated in FIG. 6.

With reference at least to FIGS. 1, 5 and 6, the locking and releasing mechanism comprises a releasing sleeve [2], a locking piece [3], a lock sleeve [4] is embedded into the anchor cone [9], both of which are connected with the locking piece [3] in the shape of an arc. The cross section of the locking piece [3] is a combination of a rectangle and a trapezoid. The rectangle part is assembled into the rectangle window of the anchor cone [9] and the trapezoid part is assembled into the trapezoid groove of the lock sleeve [4]. The inner diameter of releasing sleeve [2] is equal to the outer diameter of locking piece [3]. Unidirectional thick sawtooth threads with same pitch are set on the outside surface of open lock ring [6] and inside the lock sleeve [4]. Unidirectional thin sawtooth threads are set inside the open lock ring [6] and outside the center mandrel [8]. Left-hand threads for releasing are set at the upper portion of releasing sleeve [2]. When releasing is needed, the releasing sleeve [2] is pulled up to force the locking piece [3] out of the outer support and then the locking piece [3] is slid out of the trapezoid groove of the anchor cone [9] to realize the release of the plug self-lock to release the bridge plug.

The sealing and anti-adhering mechanism comprises a rubber cylinder [12], a slide bushing [13], a sealed mandrel [15]

and an anti-adhering layer [16]. The rubber cylinder [12] is installed on the sealed mandrel [15], and the slide bushing [13] is installed within the sealed mandrel [15] and keeps sealed with it via an O-ring [14]. One end of the slide bushing [13] is equipped with a circlip structure and a liquid discharge hole [20]. The inside of the slide bushing [13] is equipped with an annular recess. The lower portion of the sealed mandrel [15] is conical, which has an anti-adhering layer [16] set on its surface. The material of the anti-adhering layer is made of perduren or other organic material. The rubber sleeve [12] is set at the lower portion of the bridge plug, and the anchor mechanism is located between the anti-sand rubber [17] and the rubber sleeve [12] so plaster will not go into the anchor mechanism during the squeezing operation. The anti-adhering layer is made of perduren or other organic material. When the cement at the bottom of the bridge plug concretes, the anti-adhering layer is stuck with the cement. When the plug is pulled up for releasing, the anti-adhering layer is easily broken, which assures the reliable releasing of the bridge plug.

Referring to FIG. 1, (example 2), the above sealed mandrel [15] can be simplified to a sealed mandrel [15'], and the bridge plug can be refitted into a conventional bridge plug with a mandrel sealing for a conventional blocking operation. The plug can also be simplified to a sealed mandrel [15"], and the bridge plug can be refitted into hook-wall bridge plug with mandrel through, which can be associated with other downhole tools to perform a selective blocking operation.

Referring to FIG. 1, (example 3), the sealed mandrel [15] and the rubber cylinder [12] of above mentioned bridge plug can also be set at the upper portion of anchor [10] to refit the bridge plug into a conventional one (mandrel sealing). Therefore, this bridge plug can endure a more strong positive pressure and is easier to retrieve, and it is mainly employed for oil and gas fracturing operation.

What is claimed is:

1. A retrievable bridge plug, comprising a setting and anchoring mechanism, a locking and releasing mechanism and a sealing and anti-adhering mechanism, wherein (1) the setting and anchoring mechanism comprises an upper connector, a connector, a mandrel, an anchor cone, an anchor and an anchor sleeve; the upper connector connects to the connector through a pin, and the connector connects with the mandrel through a thread; a weak point of an annular recess is set at an upper portion of the mandrel, which controls a setting force of the bridge plug; on an outside surface of the anchor, there is a set of teeth which are reverse in direction a tooth-tip angle thereof ranges from 85-100°; There is a dovetail slot for a sliding connection between the anchor cone and anchor; the anchor is embedded into an open window of the anchor sleeve; a cone angle β of the anchor cone is 8-10°; an angle γ between two profile surfaces and outside surface of the anchor is 28-35°;

(2) the locking and releasing mechanism comprises a releasing sleeve, a locking piece, a lock sleeve, an open lock ring, a mandrel and an anchor cone; the lock sleeve is embedded into the anchor cone, both of which are connected with the locking piece in the shape of an arc; a cross section of the locking piece is a combination of a rectangle and a trapezoid, wherein the rectangle part is assembled into a rectangle window of the anchor cone and the trapezoid part is assembled into a trapezoid groove of the lock sleeve; an inner diameter of the releasing sleeve is equal to an outer diameter of the locking piece; unidirectional thick sawtooth threads with same pitch are set on an outside surface of the open lock ring and inside the lock sleeve; unidirectional thin sawtooth threads with same pitch are set inside the open lock ring and outside the mandrel; and left-hand threads for releasing are set at an upper portion of the releasing sleeve; and (3) the sealing and anti-adhering mechanism comprises a rubber cylinder, a slide bushing, a sealed mandrel and an anti-adhering layer; the rubber cylinder is installed on the sealed mandrel, and the slide bushing is installed within the sealed mandrel and keeps sealed with the sealed mandrel via an O-ring; one end of the slide bushing is equipped with a circlip structure and a liquid discharge hole; an inside of the slide bushing is equipped with an annular recess; a lower portion of the sealed mandrel is conical, which has an anti-adhering layer set on its surface; and the anti-adhering layer is made of perduren.

2. The retrievable bridge plug according to claim 1, wherein the sealed mandrel is configured to be refitted into another sealed mandrel, and the bridge plug can be refitted into one of a bridge plug and a hook-wall bridge plug.

3. The retrievable bridge plug according to claim 1, wherein the sealed mandrel and rubber cylinder of the retrievable bridge plug can also be set at an upper portion of the anchor to be refitted into a bridge plug.

* * * * *